United States Patent [19]

Sterwald

[11] Patent Number: 4,719,336

[45] Date of Patent: Jan. 12, 1988

[54] METHOD OF MAKING THERMAL INSULATING BLOCKS AND ELECTRICAL HEATING UNITS AND THE PRODUCTS THEREOF

[75] Inventor: Duane L. Sterwald, Watertown, Wis.

[73] Assignee: General Signal Corporation, Stamford, Conn.

[21] Appl. No.: 868,651

[22] Filed: May 30, 1986

[51] Int. Cl.[4] ..... H05B 3/44; H05B 3/50

[52] U.S. Cl. ..... 219/544; 210/388; 210/748

[58] Field of Search ..... 34/95.4; 219/544; 210/384, 388, 389, 748

[56] References Cited

U.S. PATENT DOCUMENTS

| | | | |
|---|---|---|---|
| 2,094,786 | 10/1937 | Flint | 210/388 |
| 2,632,366 | 3/1953 | Ahlfors | 210/389 |
| 3,500,444 | 3/1970 | Hesse et al. | 219/544 |
| 4,267,046 | 5/1981 | Stoev et al. | 210/388 |
| 4,278,877 | 7/1981 | Werych | 219/544 |
| 4,299,364 | 11/1981 | Loniello | 219/537 |
| 4,457,839 | 7/1984 | Bailey | 210/388 |
| 4,617,450 | 10/1986 | Boes et al. | 219/345 |

*Primary Examiner*—Elliot A. Goldberg
*Assistant Examiner*—Lincoln Donovan
*Attorney, Agent, or Firm*—Burmeister, York, Palmatier, Hamby & Jones

[57] ABSTRACT

The process of molding thermal insulating blocks and electrical heating units with a mold having a horizontal filter screen in which a slurry containing a mass of inorganic fibers, water, and a binder is mixed to randomly orient the fibers and thereafter poured into the mold and a first portion of the liquid component of the slurry drained through the screen, thereafter vibrating the screen and mold to drain a second portion of the liquid component of the slurry through the screen to produce a filter mat, thereafter drying the filter mat to remove the remaining liquid component of the slurry from the mat, and thereafter heating the filter mat to bond the fibers to each other. An electrical heating element may be mounted on the mold before the slurry is introduced into the mold. The products produced by the process have densities in excess of 30 pounds per cubic foot.

10 Claims, 3 Drawing Figures

METHOD OF MAKING THERMAL INSULATING BLOCKS AND ELECTRICAL HEATING UNITS AND THE PRODUCTS THEREOF

The present invention relates to thermal insulating blocks and to molding methods for making such blocks. Also, the present invention relates to electrical heating units using molded thermal insulating blocks and to methods of making such electrical heating units.

BACKGROUND OF THE INVENTION

The present invention is an improvement on the electrical heating unit and process for making that heating unit described in U.S. Pat. No. 3,500,444 of Mar. 10, 1970, issued to W. K. Hesse et al entitled ELECTRICAL HEATING UNIT WITH AN INSULATING REFRACTORY SUPPORT. Hesse discloses a block containing ceramic fibers in which an electrical heating element is disposed on one surface of the block. The block itself is described as preferably containing high refractory compositions, such as silica or quartz, magnesia, alumina-silica compositions including those alumina-silica compositions containing titania and/or zirconia, and synthetically produced inorganic fibers which exhibit resistance to deterioration at temperatures up to the order of 2000° to 2500° F. are described as suitable. The fibers themselves are more fully described in an article entitled "Critical Evaluation of the Inorganic Fibers" in Product Engineering, Aug. 3, 1964, pages 96–100. Hesse gives an example of the preferred means for producing the electrical heating units as comprising filter molding from a dilute water suspension of approximately 99% water and 1% solids, the solids consisting of approximately 12% binder, 84% inorganic refractory fibers, and 4% coagulant. In practice, a mat is formed by the molding process, and thereafter the mat is dried and sintered to produce the thermal insulating block.

The electrical heating elements of Hesse are generally tubular in shape and are embedded on the surface of the thermal insulating block. Electrical heating elements have also been mounted on the block in various other ways, such as by brackets as disclosed in U.S. Pat. No. 4,299,364 of Peter J. Loniello dated Nov. 10, 1981, by embedding the electrical heating elements directly beneath the surface, as disclosed by Ewald R. Werych in U.S. Pat. No. 4,278,877 entitled ELECTRICAL HEATING UNIT WITH FLATTENED EMBEDDED HEATING COIL dated July 14, 1981, and by embedding the opposite edges of a flat serpentine heating element in the walls of a slot which extends into the thermal insulating block as disclosed in U.S. patent application Ser. No. 06/608,348 of Ludwig Porzky entitled ELECTRICAL HEATING UNIT WITH SERPENTINE HEATING ELEMENT AND METHOD FOR ITS MANUFACTURE, filed May 8, 1984 now U.S. Pat. No. 4,595,619.

In all of the heating units employing molded fiber thermal insulating blocks and electrical heating elements, the lack of strength of the thermal insulating block is a deterrent to mounting the electrical heating element on the block and to maintaining it in its proper position. The lack of strength of the thermal insulating block is a direct result of the low density of the block, Hesse indicating a range from about 4 to about 30 pounds per cubic foot and preferably about 10 to 15 pounds per cubic foot. Higher densities result in binding together increased numbers of fibers to maintain the block integrity, and hence higher strength.

A second factor which affects the strength of molded fiber thermal insulating blocks is the degree of randomness of the orientation of the fibers within the block. The fibers are mixed into a substantially random universe in a suspension or slurry of water, binder and fibers prior to introducing the slurry into a mold. The fiber content by weight is only of the order of 1% of that of the water in the slurry which is introduced into the mold. However, as the water is drawn from the molded mat through a filter plate, the fibers become pressed upon one another and tend to become reoriented, particularly at the surfaces, and lose some randomness.

In the early stages of mat formation in the mold, the spaces formed between fibers, referred to herein as pores, are filled with the liquid component of the slurry and the fibers tend to float in the liquid component, hence making it necessary to remove the liquid component to increase the density of the mat. In latter stages of mat formation, gravitational attraction to the liquid component will remove a certain portion of the liquid component through an underlying filter screen, but the surface tension of the liquid component of the slurry on the fibers trapped in the mat prevents a portion of the liquid component from being drained from the mat. Accordingly, failure to remove a significant portion of the liquid component of the slurry from the mat places a restriction upon the density that can be achieved in the mat during the molding process.

The prior art has utilized principally two alternatives to facilitate removal of the liquid component of the slurry from the mat during the molding process for thermal insulating blocks. First, pressure is exerted on the mat by means of a pressure plate, usually by gravitational attraction from above. The weight of the pressure plate compresses the mat against the underlying filter screen, thereby pressurizing the liquid component of the slurry and overcoming the surface tension of the liquid component on the fibers to permit gravity to withdraw a portion of the liquid component from the pores within the filter mat. Removal of the pressure plate will allow the resiliency of the fibers to expand the mat, thereby creating partial voids in the pores of the mat, but the mat will remain partially compressed. The use of a pressure plate increases the density of the filter mat, but it tends to distort the fibers within the filter mat, and when using excessive pressures, breaks down the fibers and tends to produce cracks in the product. When a pressure plate is used, a thick membrane is formed by the fibers on the surface of the filter mat contacted by the pressure plate and the filter screen.

The second alternative comprises the use of vacuum for removing a portion of the liquid component from the filter mat during the molding process. The mold is subjected to a subatmospheric pressure of about 20 inches of mercury to facilitate removal of the liquid component from the block formed during the molding process. The use of vacuum also tends to form cracks in the finished product and forms a membrane on the surfaces of the molded block, but is effective to increase the density of the block. The fibers throughout the mat produced by a vacuum molding process are less randomly oriented than the fibers in the slurry used to form the mat, particularly at the horizontal surfaces. As a result, thermal insulating blocks produced by vacuum molding have more limited strength than desired, and are of lower density than desired.

The strength and durability of molded fiber thermal insulating blocks result from the contacting regions of adjacent fibers within the block. The liquid component of the slurry used to mold the mat contains a binder, as described above, and when the liquid component of the slurry is removed, a portion of the binder remains and adheres to the fibers, thus forming regions for each fiber that are attached to adjacent fibers by a small mass of binder. Subsequently, the mat is heated to evaporate the water within the mat and cause drying of the binder, thereby producing a thermal insulating block by binding contacting fibers together at their regions of contact in a fixed structure.

The water from the liquid component held in the pores of the filter mat on completion of the molding process cannot be mechanically removed and must be removed by evaporation. Accordingly, the filter mat is removed from the mold following the molding process and dried in an oven operating at a temperature above the boiling point of water. Suitable temperatures for drying the filter mat are in the range of 220° F. to 500° F. Sintering of the binder cannot occur until the water portion of the liquid component is evaporated, since the temperature of the binder will be held to the boiling point of water while water is present. Removal of the water as vapor is effectively achieved by the drying process, but at a cost in energy far in excess of the cost required for mechanical removal of the initial water from the filter mat. After removal of the water from the liquid component remaining in the mat, the temperature of the binder will rise to permit drying of the binder. In practice, the dried mat may then be placed in a furnace operating at a temperature sufficient to sinter the binder.

It is thus an object of the present invention to provide a fiber mat which overcomes the difficulties of such mats known to the prior art, and which may be sintered to provide an improved thermal insulating block. More specifically, the objects of this invention are to provide thermal insulating blocks containing inorganic fibers in which the fibers are more randomly oriented than such blocks prior hereto, to provide such thermal insulating blocks of higher density than the thermal insulating blocks prior to the present invention, to provide such thermal insulating blocks of fibers of greater strength than known prior to the present invention, and to provide such blocks at a lower cost than has been possible using prior art processes. In addition, it is an object of the present invention to produce electrical heating units with thermal insulating blocks of improved construction as indicated above.

THE PRESENT INVENTION

It is believed that the liquid component of the slurry is retained in the pores of the filter mat during the molding process of a fiber thermal insulating block due to the surface tension of the liquid component on the fibers, but the invention is not dependent on this theory. It is known that the regions between the fibers, referred to herein as pores, are at least partially filled with the liquid component of the slurry on completion of the molding process of the mat, even when the process is a vacuum process and a pressure plate is applied to the surface of the mat opposite the filter screen.

The present inventor has found that substantial quantities of the liquid component of the slurry may be removed from the filter mat during the molding process by subjecting the mold to vibration. The inventor believes that the application of vibration, preferably in a direction perpendicular to the horizontal plane of the filter screen, periodically adds an inertial force to the gravitational attraction on the mass of the liquid component in the pores of the mat to overcome the surface tension of the liquid component on the fibers within the filter mat, whereby a portion of the liquid component will be drawn downwardly through the filter mat and the filter screen. In addition, vibration applied to the mold and filter mat, particularly in the vertical direction, causes the fibers in proximity to the filter screen to move with respect to each other and the filter screen, thereby providing passages to permit the liquid component of the slurry to be acted upon by gravitational force to withdraw the liquid component through the filter screen from the mat. Filter plates range from 0.020 inch perforations to 0.25 inch perforations to produce plates ranging from 30% open to 58% open, respectively. Wire cloth may also be used for the screen and ranges between 100×100 mesh to 30×30 mesh.

As a result of removal of the liquid component from the pores of the mat during the molding process, the weight of each fiber no longer is at least partially transferred to the liquid component of the slurry, due to displacement of the volume of the fiber by a like volume of liquid. Hence, gravity will act directly on the fibers and the fibers become more closely packed. Further, vibration of the mold and the fibers in the mold, shakes the fibers to reduce the friction between the fibers, thus causing the fibers to shake down, more closely intermingle, and produce a higher density mat. Vibration may be combined with vacuum to further facilitate removal of a portion of the liquid component of the slurry from the mat during the molding process. Further, the use of a pressure plate during the molding process to compress the mat on the underlying filter screen will further reduce the quantity of the liquid component in the mat. Mats molded utilizing vibration according to the present invention produce a more random distribution of fibers than can be achieved with prior art processes, whether molded with or without the use of vacuum or a pressure plate, but the greatest random distribution of fibers is achieved without using vacuum or a pressure plate.

DETAILED DESCRIPTION OF THE PREFERRED EMBODIMENTS

Figure 1:
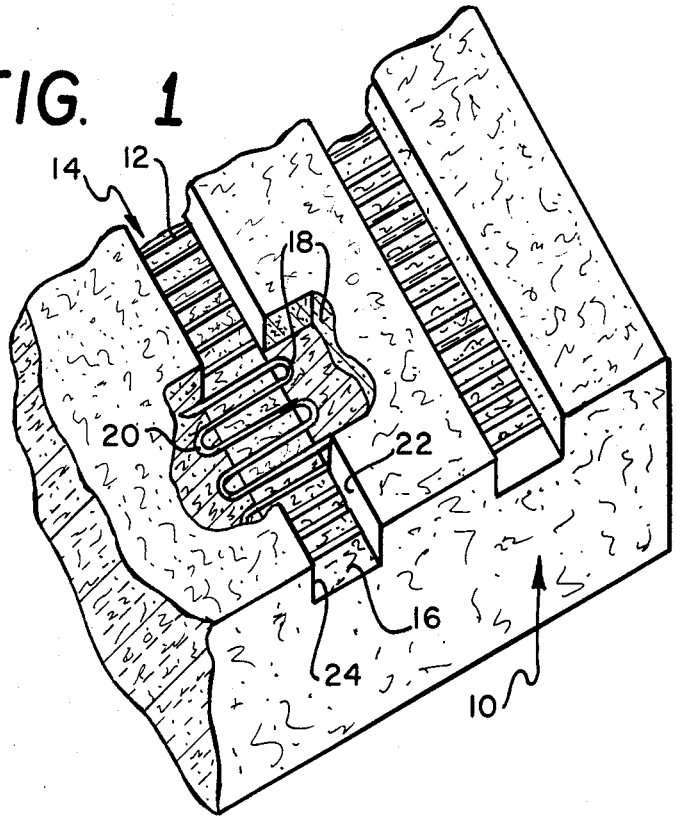
FIG. 1 is an isometric view of a thermal heating unit according to the present invention.

FIG. 1 illustrates a thermal heating unit constructed in accordance with the present invention. It has a block 10 of thermal insulating material and an electrical element 12 mounted in a slot 14 on the lower flat surface 16 of the slot. The heating element 12 is in the form of an elongated resistance wire or conductor which is provided with a first group of bends 18 and a second group of bends 20, the bends 18 being embedded in one wall 22 of the slot 14 and the bends 20 being embedded in the opposite wall 24 of the slot 14. The electrical heating element 12 is securely mounted on the block 10 as a result of the bends 18 and 20 being embedded in the block.

Figure 3:
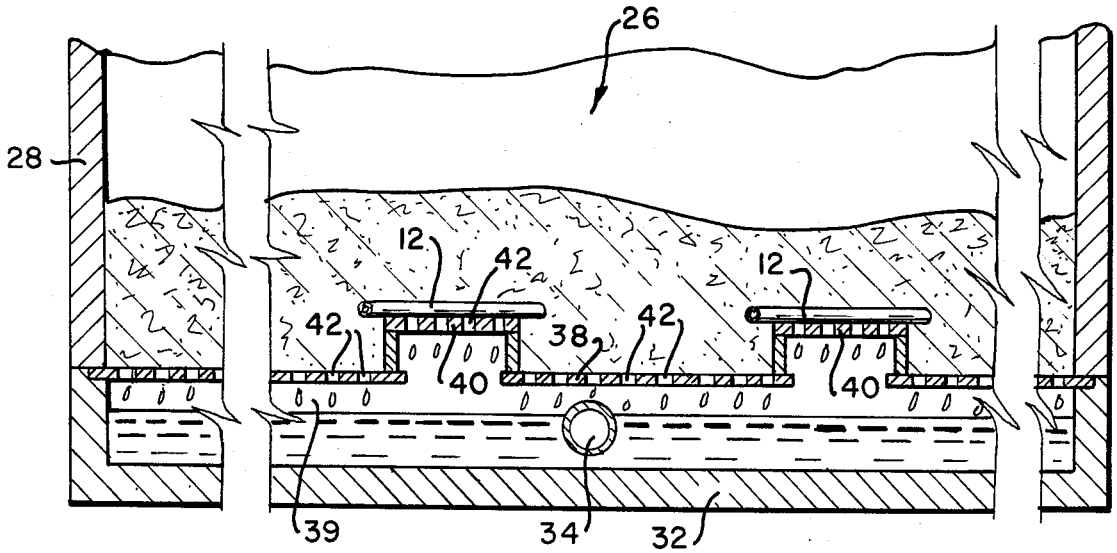
FIG. 3 is an enlarged sectional view taken along the line 3—3 of FIG. 2.
Figure 2:
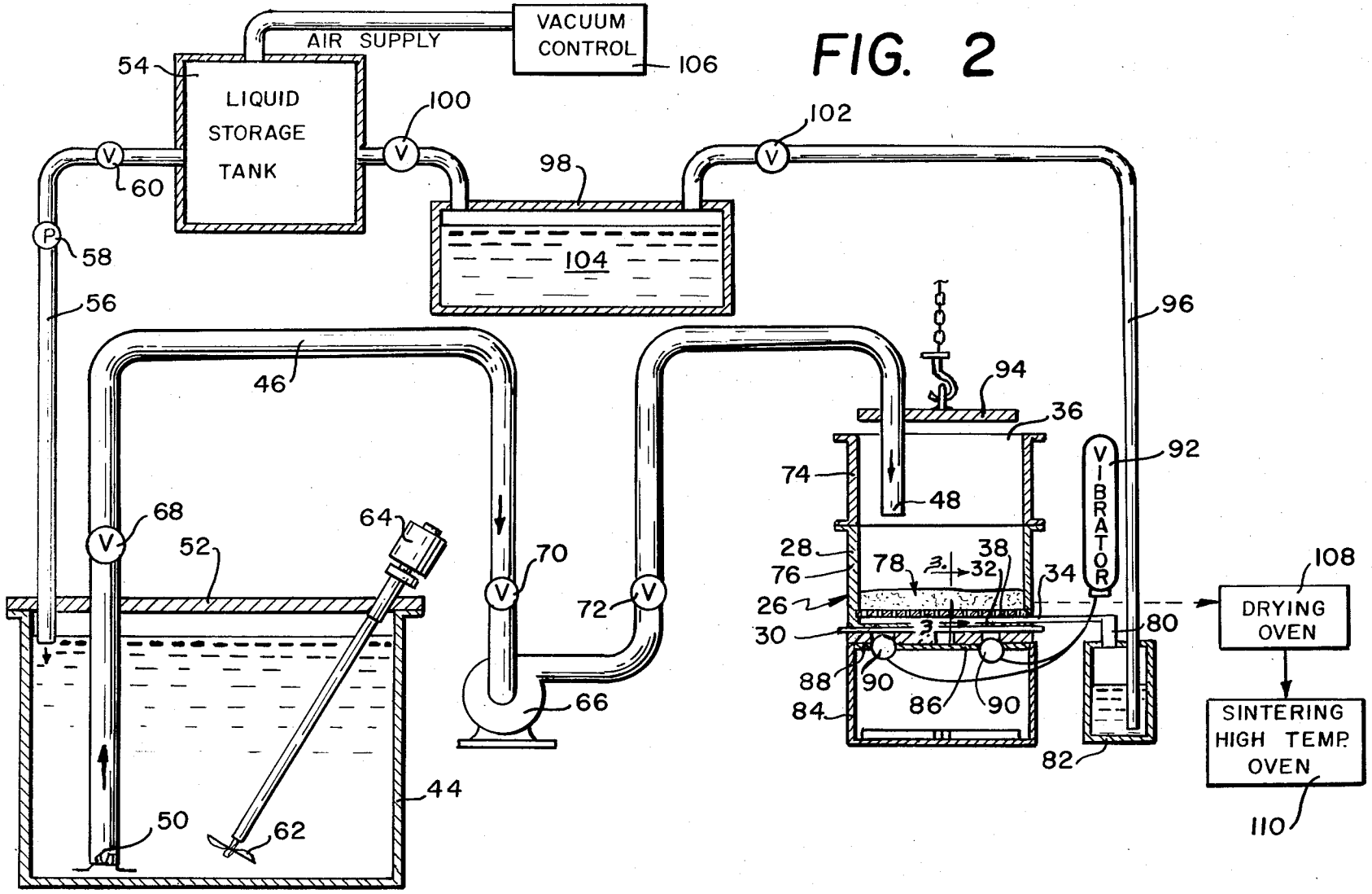
FIG. 2 is a vertical sectional view, partly diagrammatic of the apparatus used to produce the mat of FIG. 1 and carry out the present invention.

The block 10 is formed in a mold 26 illustrated in FIGS. 2 and 3. The mold 26 has a hollow rectangular housing 28 which is vertically disposed upon a table 30. The housing 28 has a water impermeable bottom 32 which is disposed horizontally on the table 30, and the housing 28 is airtight except for an aperture 34 adjacent to the bottom 32 and an upper open end 36. A perforated filter plate 38 is mounted horizontally across the lower portion of the housing above the aperture 34, thus forming a chamber 39 at the bottom of the housing 28 for receiving the liquid component of the slurry. The filter plate 38 has a plurality of plateaus 40 which rise upwardly to form a base to accommodate an electrical heating element 12, as illustrated in FIG. 3. The plateaus 40 and filter plate 38 are provided with apertures 42 of sufficient size to permit the liquid component of the slurry to pass therethrough. It has been found that a diameter between ⅛ and ¼ inch is satisfactory for the apertures 42, and in practice a screen is utilized for the filter plate 38.

A slurry mixing tank 44 is positioned near the table 30 and mold 26, and a conduit 46 extends from the slurry mixing tank toward the mold 26. One end 48 of the conduit 46, opposite the mixing tank 44 is removably disposed within the open end 36 of the mold 26. The other end 50 of the conduit 46 extends downwardly into the mixing tank to a position near the bottom of the mixing tank 44.

The slurry mixing tank 44 is utilized to mix a mass of inorganic elongated fibers into a substantially random universe with water and a binder. The tank 44 is provided with a cover 52 which may be removed to introduce the mass of inorganic fibers, and a mixture of water and binder is transported from a liquid storage tank 54 through a pipe 56 by means of a pump 58 and valve 60 to the slurry mixing tank 44.

The fibers introduced into the mixing tank may be of any of the inorganic fibers known to the prior art as described above. Refractory compositions, such as alumina-silica, titania or zirconia being particularly suitable. The fibers must be elongated and of sufficient length to permit enough contact points between adjacent fibers to produce a strong thermal insulating block. The term elongated is intended to mean in the context of the fibers a fiber having a length at least ten times that of its cross section. In practice, fibers in excess of ½ inch in length are preferred in the process, although shorter fibers, down to ¼ inch in length, may be used and will produce a higher density because they are more readily packed, but not a higher strength for the thermal block. The shorter fibers not only have less points of contact with adjacent fibers, but tend to become oriented parallel to the filter plate, thus reducing the randomness of the block and the physical strength of the block.

Longer fibers, while preferred for block strength, are difficult to orient in a random distribution in the mixing tank, and as a practical matter, fibers in excess of 2 and ½ inches are too long to orient in a random universe. In practice, inorganic fibers have lengths normally in the range of 300 to 500 microns and a diameter of approximately 5 microns.

The mixing tank 44 is provided with a mechanical mixer 62 which is driven by a motor 64. The quantity of the liquid component of the slurry present in the mixing tank 44 greatly exceeds the quantity of fibers in the mixing tank by weight in order to facilitate mixing the fibers into a random universe. In practice, the liquid component is approximately 75% of the slurry by weight. In a preferred example, the water constituted 52.5% of the slurry by weight and the binder constituted 22.5% of the slurry by weight. In the particular example, the binder utilized was a commercial product known as NH4 2326. The binder may form from 5% to 50% of the liquid component of the slurry, and is preferably in the range of 10 to 30% of the liquid component of the slurry, the remainder being water.

The conduit 46 is provided with a pump 66 and valves 68, 70 and 72. When it is desired to transfer slurry from the mixing tank 44 to the mold 26, the valves 68, 70 and 72 are at least partially opened, and the pump 66 is activated. Slurry will pour from the open end 48 of the conduit into the mold 26, filling a portion of the housing 28 above the filter plate 38. The greater the quantity of slurry placed in the mold, the thicker the mat will become during production. As illustrated in FIG. 2, the housing 28 has an upper section 74 and a lower section 76, the upper section 74 being removable to reduce the mass of the mold on the vibration table 30. Also, the lower section is removably mounted on the filter plate 38 by mechanical means not shown, so that the lower section may be removed from the filter plate to remove the mat therefrom, the mat being indicated at 78.

Once the slurry has been introduced into the mold 26, the liquid component will start to drain through the filter plate 38 as a result of gravitational attraction. A buildup of the liquid component will occur in the chamber 39 between the bottom 32 of the housing 28 and the filter plate 38. The liquid component will then drain from the chamber 39 through the aperture 34 and a tube 80 to a reservoir 82. The flow of the liquid component of the slurry through the apertures 42 of the filter plate 48 will, however, stop long before the liquid component can be drained from the mat 78, as indicated above. To remove a further portion of the liquid component, an additional force must be applied to the liquid component to cause it to depart the mold. In accordance with the present invention, vibration is applied to the mold to achieve this end.

The table 30 which supports the mold 26 is a vibration table, and it may be any of the commercial vibration tables. As illustrated in FIG. 2, the table is provided with a rectangular base 84, and the base 84 has an upper wall 86 which supports the table 30 by means of a plurality of resilient spacer bars 88. Two vibrator units 90 are mounted on the wall 86 and are mechanically coupled to the table 30. The vibrator units are controlled by a control box 92, and when activated, the vibrator units 90 cause the table 30 to vibrate on an axis substantially perpendicular to the table 30, that is, on a vertical axis. The vibration of the table 30 is achieved by virtue of the resiliency of the spacer bars 80 which are disposed between the table 30 and the upper wall 86 of the base 84. The vibration frequency is not critical, the removal of the liquid component not being a function of mechanical resonance. In practice, it has been found that a vibration at the rate of 1 to 5 cycles per second is effective.

Additional liquid component may be removed from the mat 78 by the application of pressure from a pressure plate, and accordingly, a pressure plate 94 is illustrated positioned above the open end 36 of the mold 26, the conduit 46 first being removed before introduction of the pressure plate. In addition, vacuum may be applied to remove a further portion of the liquid component. It should however be understood that neither the pressure plate nor the vacuum need be employed, vibration alone producing a significant removal of the liquid component from the mat.

Whether vacuum is used or not, the reservoir 82 is connected to the liquid storage tank 54 by a second conduit 96. The conduit 96 passes through a second reservoir 98 which is provided with valves 100 and 102 at the opposite ends thereof. The reservoir 98 can be used to retain a portion of the liquid component of the slurry removed from the mat, in order to achieve a proper mix of binder and water in the liquid storage tank 54. A mass of binder and water is shown at 104 in the second reservoir 98.

A vacuum unit 106 is connected to the liquid storage tank 54, and when the valves 100 and 102 are opened, the vacuum unit will evacuate the chamber 39 between the filter plate 38 and the bottom 32 of the housing 28. In this manner, vacuum may be employed to facilitate removal of the liquid component from the mat 78.

When the free liquid component of the slurry has been removed, the trapped component must be removed by evaporation. The lower portion 76 of the mold 26 is removed from the filter plate 28 and the mat 78 removed. In practice, the mat is then placed in a drying oven 108 at a temperature of from 220° F. to 2000° F. for a period of time to remove the remaining water retained within the mat. Preferably the oven 108 is maintained at a temperature of from 220° F. to 500° F. for a period of 10 to 20 hours. After the water has been evaporated from the mat 78, the mat may be cut or machined. The final step in production of the unit is to sinter the binder in the mat, and for this purpose, the mat is placed in a high temperature oven 110 and sintered at a temperature between 1600° F. and 3000° F. for a period of time sufficient to complete sintering, preferably a temperature of the order of 1600° F. for a period of approximately 6 hours.

Thermal insulating mats, and electrical heating units, produced as described above, have the advantage of greater strength. The density of the mat produced in accordance with the process described above using only vibration was 23 lbs. per cubic foot, whereas production of the same mat using a pressure plate and vacuum produced a mat of 18 lbs. per cubic foot. The inventor has found that mats may be produced according to the present invention using vibration, without a pressure plate, having densities from 12 to 75 lbs. per cubic foot, whereas such mats may be produced using a pressure plate without vibration having densities from 4 to 25 lbs. per cubic foot. The use of vibration to remove a portion of the liquid component from the mat permits control of the density of the mat which was not possible with vacuum molding or the use of a pressure plate. In addition, the use of vibration only in producing a mat eliminates or avoids the production of thick membranes on the upper and lower surfaces of the mat and is particularly suitable for the production of electrical heating units as shown in FIG. 1.

The addition of varying ranges of shorter ceramic fiber materials or other finely divided ceramic materials, and/or higher concentrations of binders, facilitates production of higher density mats. By the use of shorter fibers, and larger concentrations of binder, mats have been produced with densities of 60 lbs. per cubic foot.

Those skilled in the art will devise many uses for the present invention beyond that here described. It is therefore intended that the scope of the present invention be not limited by the foregoing specification, but rather only by the following claims.

The invention claimed is:

1. The process of producing a thermal insulating block comprising the steps of mixing a mass of elongated inorganic fibers, water and a binder to form a slurry, the mass of the water being greater than the mass of the inorganic fibers and the fibers being substantially randomly disposed in the slurry, thereafter transferring the slurry to a mold having a confined area over a filter screen and passing a part of the slurry through the filter screen to trap and accumulate the inorganic fibers in a mat on one side of the filter screen and divide the liquid component of the slurry into two portions, the first portion of the liquid component of the slurry passing through the filter screen and the second portion of the liquid component of the slurry remaining on the one side of the filter screen with the mat, maintaining the filter screen in contact with the mat and positioned beneath the mat and subjecting the filter screen to mechanical vibration, whereby a part of the second portion of the liquid component flows by gravity downwardly through the filter screen and the mat settles on the filter screen, thereafter removing the mat from the screen, and evaporating water from the mat.

2. The process of producing a thermal insulating block comprising the steps of claim 1 wherein the filter screen is vibrated along the vertical axis.

3. The process of producing a thermal insulating block comprising the steps of claim 2 wherein the filter screen is vibrated at a frequency below the frequency of mechanical resonance of the filter screen and the load associated therewith.

4. The process of producing a thermal insulating block comprising the steps of claim 1 wherein the step of evaporating the water remaining in the mat is conducted in an oven operating at a temperature between 220° F. and 2000° F. for a period of time sufficient to substantially dry the mat.

5. The process of producing a thermal insulating block comprising the steps of claim 4 in combination with the step of thereafter subjecting the mat to a temperature between 1600° F. and 3000° F. for a sufficient period to crystalize the binder within the mat.

6. The process of producing an electrical heating unit comprising the steps of claim 1 in combination with the step of positioning an elongated electrical resistance heating element on the upper surface of the filter screen before passing a part of the slurry through the filter screen.

7. The process of producing an electrical heating unit comprising the steps of claim 6 wherein the electrical heating element is formed into an elongated serpentine structure with two groups of bends on opposite sides thereof, and the heating element is positioned on an elongated plateau extending upwardly from the filter screen with the two groups of bends extending outwardly from opposite sides of the plateau.

8. A thermal insulating block made by the method of claim 5 wherein the density of the block exceeds 30 pounds per cubic foot.

9. An electrical heating unit made by the method of claim 6 wherein the density of the block exceeds 30 pounds per cubic foot.

10. An electrical heating unit made by the method of claim 7 wherein the density of the block exceeds 30 pounds per cubic foot.

* * * * *